United States Patent [19]

Bennett et al.

[11] 4,235,697

[45] Nov. 25, 1980

[54] OXYGEN SELECTIVE ANODE

[75] Inventors: John E. Bennett; Joseph E. Elliott, both of Painesville, Ohio

[73] Assignee: Diamond Shamrock Corporation, Dallas, Tex.

[21] Appl. No.: 88,891

[22] Filed: Oct. 29, 1979

Related U.S. Application Data

[62] Division of Ser. No. 890,374, Mar. 27, 1978, Pat. No. 4,180,445.

[51] Int. Cl.[3] ..... C25D 11/04; C25D 11/10; C25D 11/16

[52] U.S. Cl. ..... 204/290 F; 204/290 R; 204/291

[58] Field of Search ..... 204/290 R, 290 F, 290 K, 204/291

[56] References Cited

FOREIGN PATENT DOCUMENTS 2723406 12/1977 Fed. Rep. of Germany ..... 204/290 K
194340 3/1923 United Kingdom ..... 204/291

*Primary Examiner*—R. L. Andrews
*Attorney, Agent, or Firm*—John P. Hazzard

[57] ABSTRACT

Novel oxygen selective electrode comprising a coating on said anode consisting of delta manganese dioxide. This outer coating on the anode may be placed on the anode electrochemically by electrolyzing an acid saline solution having dissolved therein sufficient manganous chloride. Sufficient manganese dioxide is plated on said anode when the chlorine evolution essentially ceases during electrolysis.

2 Claims, No Drawings

OXYGEN SELECTIVE ANODE

This is a division of application Ser. No. 890,374, filed Mar. 27, 1978, now U.S. Pat. No. 4,180,445.

BACKGROUND OF THE INVENTION

This invention generally relates to electrodes for use in electrochemical processes wherein it is desired to evolve oxygen at the anode and particularly where chloride ion is present in the electrolyte. Two prime examples of this are evident from the following discussion.

Several proposals have been suggested for sea-based power plants for deriving energy from ocean thermal gradients, wind and wave generators, and from nuclear breeder reactors placed at sea so as to minimize thermal pollution. A number of such proposals have suggested the direct electrolysis of seawater as a convenient source of hydrogen on a large scale. Such electrolytic hydrogen could then be shipped ashore or could be combined with carbon dioxide extracted from seawater to produce methane, methanol, and other light fuels for transportation to the land masses of the earth for use as an energy source. A major problem, however, exists in this area in that the usual electrode materials and conditions of electrolysis for seawater favor the evolution of chlorine anodically rather than oxygen and thus massive quantities of by-product chlorine would necessarily be generated by any such major power plant. Such generated by-product chlorine could not be discharged to the environment even at mid-ocean and would be extremely costly to convert back to chloride. By the practice of the instant invention, the chlorine evolution at the anode of such a system would be essentially eliminated and oxygen would instead be released at said anode, obviating all of the expensive methods required to convert chlorine gas back to a chloride form.

In various other electrochemical processes such as, for example, in the production of chlorine and other halogens, the production of chlorates, the electrolysis of other salts which undergo decomposition under electrolysis conditions, it has recently become commercially possible to use dimensionally stable electrodes in place of graphite or the like. These dimensionally stable electrodes usually have a film-forming valve metal base such as titanium, tantalum, zirconium, aluminum, niobium and tungsten, which has the capacity to conduct current in the cathodic direction and to resist the passage of current in the anodic direction and are sufficiently resistant to the electrolyte and conditions used within an electrolytic cell, for example, in the production of chlorine and caustic soda, to be used as electrodes at electrolytic processes. In the anodic direction, however, the resistance of the valve metals to the passage of current goes up rapidly, due to the formation of an oxide layer thereon, so that it is no longer possible to conduct current in the electrolyte in any substantial amount without substantial increase in voltage which makes continued use of uncoated valve metal electrodes in an electrolytic process uneconomical.

It is, therefore, customary to apply electrically conductive electrocatalytic coatings to these dimensionally stable valve metal electrode bases. The electrode coatings must have the capacity to continue to conduct current to the electrolyte over long periods of time without becoming passivated, and in chlorine production must have the capacity to catalyze the formation of chlorine molecules from the chloride ions at the anode. Most of the electrodes utilized today catalyze the formation of chlorine molecules. These electroconductive electrodes must have a coating that adheres firmly to the valve metal base over long periods of time under cell operating conditions.

The commercially available coatings contain a catalytic metal or oxide from the platinum group metals, i.e., platinum, palladium, iridium, ruthenium, rhodium, osmium, and a binding or protective agent such as titanium dioxide, tantalum pentoxide and other valve metal oxides in sufficient amount to protect the platinum group metal or oxide from being removed from the electrode in the electrolysis process and to bind the platinum group metal or oxide to the electrode base. Other such electrocatalytic coatings are described in U.S. Pat. No. 3,776,384, U.S. Pat. No. 3,855,092, U.S. Pat. No. 3,751,296, U.S. Pat. No. 3,632,498, and U.S. Pat. No. 3,917,518. Any of the foregoing electrodes, whether carbon, metallic, electrocatalytic coated valve metal, or the like, are useful in the practice of the instant invention as each may serve as the base for the oxygen-selective coating of the instant invention.

In anodes for the recovering of metals by electrowinning, a continual source of difficulty has been the selection of a suitable material for the anode. The requirements are insolubility, resistance to the mechanical and chemical effects of oxygen liberated on its surface, low oxygen overvoltage, and resistance to breakage in handling. Lead anodes containing 6 to 15 percent antimony have been used in most plants. Such anodes are attacked by chloride if present in the electrolyte. This is the case in Chuquicamata, Chile, where it is necessary to remove cupric chloride dissolved from the ore by passing the solution over reducing material so as to reduce the cupric to insoluble cuprous chloride. This adds to the expense of the process immensely whereas by the use of an oxygen selective anode, the cupric chloride in solution would not be evolved as chlorine gas to any great extent, and thus eliminating the need for the reduction of the cupric chloride to insoluble cuprous chloride.

OBJECTS OF THE INVENTION

It is an object of the instant invention to provide a novel anode for oxygen evolution having an outer coating of delta manganese dioxide. It is an additional object of the invention to provide a novel electrode which, when used in the electrolysis of saline solutions, produces oxygen gas at the anode in deference to the normal halogen gas production at the anode. It is a further object of the invention to prepare the anode surface coating in situ which avoids damage to said electrode when being transported to the point of use. It is a still further object of the instant invention to provide a novel process for the electrowinning of metals wherein chloride content in the electrolyte does not generate chlorine gas which might injure the electrodes or create a corrosive atmosphere which leads to quick decreases in efficiency for the overall electrolytic operation.

It is still a further object of the instant invention to provide a novel method for the application of an oxygen selective surface coating to an anode wherein the anode will selectively evolve oxygen in the presence of chloride ions.

THE INVENTION

The improved electrode of the instant invention which will overcome many of the disadvantages of the prior art, consist of an anode having a topcoating of delta manganese dioxide. The substrate on which the delta manganese dioxide is deposited can be of any normal electrode material, preferably, however, the base electrode material would be a valve metal substrate having an electroconductive surface thereon and be dimensionally stable under operating conditions. The valve metal substrate of the preferred form of the invention which forms the base component of the electrode, is an electroconductive metal having sufficient mechanical strength to serve as a support for the coating and should have high resistance to corrosion when exposed to the interior environment of an electrolytic cell. Typical valve metals include aluminum, molybdenum, niobium, tantalum, titanium, tungsten, zirconium and alloys thereof. A preferred valve metal based on cost, availability and electrical and chemical properties is titanium. There are a number of forms the titanium substrate may take in the manufacture of an electrode, including, for example: solid sheet material, expanded metal mesh material with a large percentage of open area, and a porous titanium which has a density of 30 to 70 percent pure titanium which can be produced by cold-compacting titanium powder.

The semi-conductive intermediate coating in the preferred embodiment can be of a solid solution-type coating consisting essentially of titanium dioxide, ruthenium dioxide, and tin dioxide such as disclosed in U.S. Pat. No. 3,776,834. Other such semi-conductive intermediate coatings can be utilized such as those described in the other prior art patents mentioned previously as well as others known in the art. The particular intermediate coating chosen is merely a matter of choice and is not a requisite portion of the instant invention, although such coatings are to be considered part of the preferred embodiment.

There are a number of methods for applying such semi-conductive intermediate coatings on the surface of the valve metal substrate. Typically, such coatings may be formed by first physically and/or chemically cleaning the substrate such as by degreasing and etching the surface in a suitable acid, or by sandblasting, then applying a solution of the appropriate thermally decomposable compounds, drying, and heating in an oxidizing atmosphere. The compounds that may be employed include any thermally decomposable inorganic or organic salt or ester of the metal desired to be used in the intermediate coating. Such processes are fully described in the previously cited U.S. patents and need not be repeated herein. Once the substrate electrode is selected and/or completed, the only aspect remaining is the application of the topcoating of delta manganese dioxide.

The method of applying the delta manganese dioxide consists of taking the electrode substrate and making the same anodic in an acidic saline solution containing manganous ($Mn^{++}$) ions and continuing the flow of current until the evolution of chlorine gas essentially ceases at said anode. At this point, said anode substrate has deposited thereon a sufficient coating of delta manganese dioxide, to be effective in operating with oxygen selectivity. In the preferred method, an electrode having a DSA ® dimensionally stable anode coating would be made anodic in an acidic saline solution having dissolved therein manganous chloride ($MnCl_2$). Typically this solution could be of any salt concentration but preferably the coating would be laid down from a solution which would be the same as the saline solution which the electrode would be intended to be used with. Thus, for an anode intended for use in the electrolysis of seawater, an acidic seawater solution with added manganous chloride would be used as the electrolyte when laying down the topcoat of manganese dioxide on the anode. The concentration of manganous chloride added to the electrolyte can vary widely and if insufficient amounts of manganous chloride are added initially, so that the chlorine evolution does not substantially cease additional manganous chloride can be added at a later time until chlorine evolution substantially ceases at the anode. The minimum thickness for an effective coating appears to be one having about 10 mg. Mn per square foot. A thicker coating of manganese dioxide can likewise be obtained merely by extending the electrolysis beyond the point where chlorine evolution ceases with no decrease in effectiveness. However, the method of applying the $MnO_2$ coating appears to be self-limiting with respect to thickness obtainable. Thus, one practicing the instant invention, need only discontinue the deposition of the coating on the electrode at any time after chlorine evolution has substantially minimized. In any event, the electrolytic deposition of delta manganese dioxide on the anode is most effective as will be evidenced by the later examples in the specification.

Manganese dioxide has been applied electrolytically to anodes in the past, see, for example, U.S. Pat. No. 4,028,215. However, the resulting anodes in this U.S. Pat. No. 4,028,215 are not oxygen selective. This is clearly indicated in that some of the specific uses for the anodes of this patent include the use of such anodes in the production of chlorine or hypochlorite which would be impossible with an oxygen selective anode such as described in the instant invention. In this prior art patent, the manganese dioxide coating on the anode is electrodeposited from a dissolved salt of manganese sulfate. In this case the manganese is in the +4 valence state and results in a crystalline manganese dioxide deposit on the anode. This is in contradistinction to the instant invention where the manganous chloride ($Mn^{++}$) yields an anode having an amorphous manganese dioxide coating which is oxygen selective. The manganese dioxide coating of the instant invention when viewed in scanning electron micrographs, reveals a rough cracked coating which completely covers the anode understructure. All attempts to characterize the coating with X-ray diffraction have not revealed any distinct crystalline pattern, but only a broad amorphous ring. For these and other reasons, it has been concluded that the exact form of the manganese dioxide in the instant invention is the delta manganese dioxide.

EXAMPLE 1

For this example, a dimensionally stable anode was chosen which consisted of a titanium substrate which had previously been coated with an electroconductive, electrocatalytic coating consisting of a mixture of the oxides of titanium, ruthenium and tin in the following weight ratios: 55% $TiO_2$, 25% $RuO_2$, and 20% $SnO_2$. This anode was made anodic in a solution containing 28 grams per liter sodium chloride, 230 milligrams per liter manganous chloride ($MnCl_2$), and 10 grams per liter HCl. Delta manganese dioxide was deposited anodically at a current density of 155 milliamps per square centimeter for 20 minutes at 25° C. Chlorine was evolved during the first part of the deposition, but this is quickly replaced by oxygen evolution.

The anode prepared in this way was then placed in a fresh solution containing 28 grams per liter of sodium chloride. Upon electrolysis at 155 milliamps per square centimeter and at 25° C., hydrogen was evolved at the cathode while oxygen was evolved at the anode at 99% efficiency.

EXAMPLE II

Utilizing an electrode such as described in the previous Example, but one which did not contain the amorphous manganese dioxide coating, the electrolysis of 28 grams per liter salt water at 155 milliamps per square centimeter at 25° C., produced oxygen at the anode at only an 8% current efficiency.

EXAMPLE III

This example is typical of the state of the art of electrolytic $MnO_2$ coated electrodes. In this example, manganese dioxide was deposited electrolytically on an etched titanium surface in the usual prior art method from a solution containing 80 grams per liter manganese sulfate and 40 grams per liter sulfuric acid. Deposition took place at a temperature in the range of 90° to 94° centigrade and the current was applied at 8 amps per square foot for 10 minutes.

The anode prepared in this way was then placed in a fresh solution containing 28 grams per liter sodium chloride as per Example I. No efficiency measurement could be taken, as the manganese dioxide coating rapidly dissolved into solution turning the electrolyte brown. A rapid increase in cell voltage then ended the test.

EXAMPLE IV

This is an example of an electrode having a thermal manganese dioxide coating thereon. Here, manganese dioxide was deposited thermally on an etched titanium surface by brush-coating a 50% solution of $Mn(NO_3)_2$ followed by baking in an oxidizing atmosphere at approximately 250° C. for 15 minutes. This procedure was repeated for three coats. The anode prepared in this way was then placed in a fresh solution containing 28 grams per liter sodium chloride as per Example I. Although an oxygen efficiency of 70% was initially measured, the coating was again unstable, dissolving into solution and turning the electrolyte brown and the oxygen efficiency rapidly deteriorated.

EXAMPLE V

An amorphous manganese dioxide coated anode was prepared by electrolysis in acid chloride solution as described in Example I.

The anode prepared in this way was then placed in a fresh solution containing 300 grams per liter sodium chloride and electrolysis was conducted at 155 milliamps per square centimeter at 25° C. Oxygen was evolved at the anode at a 95% current efficiency.

EXAMPLE VI

Example III was repeated utilizing the anode without the amorphous manganese dioxide coating. In this electrolysis under the exact same conditions as Example III, the untreated dimensionally stable electrode evolves oxygen at only 1% current efficiency under the same conditions.

The foregoing examples clearly indicate the improvement in current efficiency realized when forming oxygen at the anode compared to the electrodes that have not been coated with the delta manganese dioxide. The results shown in the Examples are typical of the various dimensionally stable coatings applied to dimensionally stable anodes. The best of the prior art anodes is a platinum coated anode which has been doped with 1½% antimony which gives a current efficiency for oxygen evolution of 28%. Lead oxide anodes give a current efficiency of 24% whereas most of the other dimensionally stable anode materials give current efficiencies of less than 10%. For example, a platinum titanium coating gave 8% current efficiency which was in line with most of the other dimensionally stable coated anodes.

As indicated earlier, the anodes of the instant invention are also useful in the field of electrowinning metals from ore sources. For example, electrowinning of copper from copper sulfate solutions is one of the common methods of recovering copper metal. Such ore sources are often contaminated with some copper chloride. In normal practice, the electrolysis of the copper sulfate containing copper chloride impurity results in the liberation of chlorine gas which is both hazardous to health as well as very corrosive on the electrowinning equipment. By using the anodes of the instant invention, the chlorine evolution is suppressed in favor of oxygen production at the anode, thus eliminating the health problem as well as the potentially corrosive conditions that would be generated upon the liberation of chlorine gas without having the expensive pre-treatment of the ore to remove cupric chloride contaminating same.

What is claimed is:

1. An anode comprising an electrically conductive base having at least a portion of the surface of said base having a coating of delta manganese dioxide thereon.

2. An anode according to claim 1 wherein the electrically conductive base is a valve metal having coated thereon an electrolytically-conductive electrocatalytic, dimensionally stable coating.

* * * * *